US006687909B1

(12) United States Patent
Witkoff

(10) Patent No.: US 6,687,909 B1
(45) Date of Patent: Feb. 10, 2004

(54) SUN VISOR FOR SAFETY HELMET

(75) Inventor: Robert Steven Witkoff, Sedona, AZ (US)

(73) Assignee: Robert Steven Witkoff Design Innovations, Inc., Sedona, AZ (US)

( * ) Notice: Subject to any disclaimer, the term of this patent is extended or adjusted under 35 U.S.C. 154(b) by 0 days.

(21) Appl. No.: 10/197,612

(22) Filed: Jul. 16, 2002

(51) Int. Cl.[7] ..... A61F 9/00; A42B 1/08
(52) U.S. Cl. ..... 2/12; 2/424
(58) Field of Search ..... 2/422, 12, 424, 2/431, 432, 9, 425

(56) References Cited

U.S. PATENT DOCUMENTS 4,475,254 A * 10/1984 Bay ..... 2/424
4,794,652 A * 1/1989 Piech von Planta et al. ..... 2/12
5,093,937 A * 3/1992 Kamata ..... 2/424
D327,752 S * 7/1992 Lee ..... D29/109
5,177,810 A * 1/1993 Minton et al. ..... 2/10
5,365,615 A * 11/1994 Piszkin ..... 2/422
5,469,584 A * 11/1995 Casartelli ..... 2/422
5,544,027 A * 8/1996 Orsano ..... 2/422
5,555,570 A * 9/1996 Bay, Jr. ..... 2/424
5,564,128 A * 10/1996 Richardson ..... 2/422
5,896,587 A * 4/1999 Gentry ..... 2/425
6,029,271 A * 2/2000 Banuchi ..... 2/9
6,056,400 A * 5/2000 Knepp ..... 2/12

* cited by examiner

*Primary Examiner*—Rodney M. Lindsey
(74) *Attorney, Agent, or Firm*—Rossi & Associates

(57) ABSTRACT

A safety helmet has a shell, which can be a full face or open face type for encasing at least a portion of the user's head, a face shield mounted to the shell, and a sun visor mounted to an upper portion of the face shield. The face shield can be retractably or rotatably displaceable. The sun visor has a center section, a first wing section extending from a first side of the center section, and a second wing section extending from a second side of the center section that is opposite to the first side of the center section. The first wing section has a first mounting device mounting the sun visor to a first upper side of the face shield, and the second wing section has a second mounting device mounting the sun visor to a second upper side of the face shield that is opposite to the first upper side of the face shield. The sun visor can be fixedly or detachably mounted to the face shield or formed as an integral part of the face shield.

22 Claims, 8 Drawing Sheets

SUN VISOR FOR SAFETY HELMET

BACKGROUND

Although safety helmets, particularly for motor sports such as motorcycling, snowmobile riding, automobile racing, etc., come in variety of styles and shapes, they can be generally categorized as a half-helmet, an open-face helmet, and a full-face helmet. The half-helmet typically rests on the top half of the rider's head, usually above the ears, exposing the face and neck areas. The half-helmet generally does not have a face shield, but can sometimes include a sun visor that is either integral with or detachably mounted to the half-helmet. The open-face helmet is similar to the half-helmet, but covers the ears and the full back side of the head offering a greater degree of protection. The open-face helmet can include a face shield mounted to the helmet or in some cases a detachable sun visor as in the case of the half-helmet. The full-face helmet is similar to the open-face type, but provides an even greater degree of protection by the inclusion of a chin guard and a retractable face shield, such that the entire head and face is protected. A newer variation of the full-face helmet is the modular helmet. The modular helmet is essentially the same as full-face helmet, but the chin guard—to which the face shield is usually attached—can be lifted to a raised position to facilitate putting the helmet on and taking the helmet off. For the purposes of this discussion, the modular helmet will be considered a full-face helmet.

As stated above, full-face helmets typically include a retractable face shield. The face shield, which protects the user's eyes and the surrounding area, is typically detachably mounted, so that face shields of different shades and tints can be mounted to the full-face helmet. Depending on its tint and/or color, the face shield can also protect the eyes from sun glare to some degree. Typically, however, one is required to change the face shield according to the particular driving conditions. A clear face shield is needed at night, for example, while a tinted face shield may be preferred during the day to help with sun glare. Accordingly, a rider must carry more than one face shield at all times if the rider is to be properly prepared for a wide variety of driving conditions. The requirement for carrying multiple face shields is cumbersome, and sometimes leads riders to "stretch" the riding envelope by utilizing the wrong shield for a given driving situation instead of carrying multiple shields. Another disadvantage of the use of multiple face shields is that the face shields cannot be easily switched while riding, thereby making it impossible to quickly compensate for varying degrees of sun glare.

U.S. Pat. No. 5,131,101 issued to Chin discloses the use of a tinted auxiliary shield in an attempt to solve the disadvantages of the full-face helmet discussed above, wherein the tinted auxiliary shield slides up and down over the regular face shield. The auxiliary shield of Chin, however, can only provide a limited amount of glare protection, as the user is required to look through the auxiliary shield and the auxiliary shield does not extend from the face shield. In effect, the auxiliary shield of Chin allows for swapping between a clear shield and a tinted shield without removing the face shield, but cannot be made sufficiently opaque to deal with severe sun glare due to the requirement of the user must be able to look through auxiliary shield.

Being blinded by the sun or sun glare is potentially one of the most dangerous situations one can face in a motor sport.

In full-face helmets, the face shield is usually sloped upward making it quite susceptible to the sun glare problem, particular in situations where the angle of the sun is such that the sun's rays cause glare even if the rider is wearing sunglasses or using a tinted shield or auxiliary shield. A conventional sun visor cannot be attached to a full-face helmet, as it would interfere with the operation of the face shield. Accordingly, while full-face helmets provide the greatest degree of crash protection, they are also the most susceptible to the problem of sun glare. It would therefore be desirable to provide a sun visor that could be utilized with a full-face helmet or with other helmet types that cannot use a conventional sun visor due to interference with a face shield.

SUMMARY

The present invention relates to a sun visor for a full-face helmet that uses a face shield and a safety helmet that incorporates the present sun visor.

Accordingly, one aspect of the present invention is a sun visor for a safety helmet that uses a face shield. The sun visor includes a sun visor body and a mechanism for attaching the sun visor body to the face shield. Alternatively, the sun visor is formed integral with the face shield. In a preferred embodiment, the sun visor has a center section, a first wing section, and a second wing section. The first wing section extends from a first side of the center section and the second wing section extends from a second side of the center section, generally laterally opposite to the first side. The first wing section has a first mounting structure for mounting the first wing section to a first upper side of the face shield. The second wing section has a second mounting structure for mounting the second wing section to a second upper side of the face shield, laterally opposite to the first upper side of the face shield.

The sun visor can include at least one double-sided tape for fixedly mounting each of the first and second mounting structures to the face shield.

Alternatively, the sun visor can include at least one clip for mounting each of the right and left wing sections to the respective upper side of the face shield. The clip can have a plurality of supports that detachably hold the respective mounting structure. The clip can be mounted to the face shield with a double-sided tape or adhesive. Each clip can have a plate and the supports can comprise first, second, and third anchors extending from one side of the plate. The first anchor can be vertically spaced from the second and third anchors, and the second and third anchors can be horizontally spaced, with the first anchor positioned therebetween. Each of the first and second mounting structure can comprise a flange extending from the respective wing section for engaging the first, second, and third anchors.

The first and second wing sections can be curved and substantially complementary to a curvature of the face shield. At least the first and second wing sections can be flexible. The first and second wing sections can be angled offset in relation to the center section so that the center section is spaced from the face shield to allow air to flow between the face shield and the center section.

The sun visor can further include a visibility enhancing device, which can include at least one flashing LED.

Another aspect of the present invention is a safety helmet having a shell for encasing at least a portion of a head, a face shield mounted to the shell, and the above described sun visor mounted to the upper portion of the face shield. The safety helmet can have a full-face shell or an open-face shell.

BRIEF DESCRIPTION OF THE DRAWINGS

These and other features, aspects, and advantages of the present invention will become more apparent from the following description, appended claims, and accompanying exemplary embodiments illustrated in the drawings, wherein:

DETAILED DESCRIPTION

Figure 1:
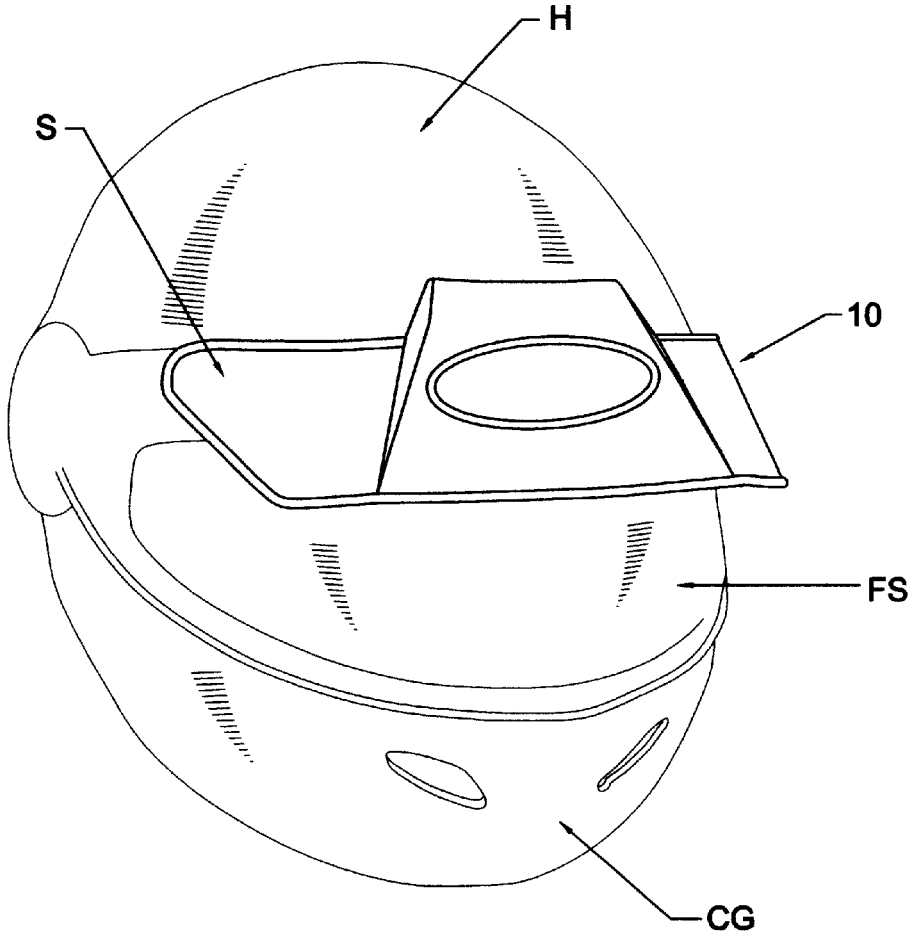
FIG. 1 illustrates an exemplary full-face helmet with a sun visor mounted to a retractable face shield according to the present invention.

The exemplary embodiments, as shown in FIGS. 1–10A, merely serve to illustrate examples of the present invention. In this regard, same or corresponding elements are labeled with the same reference numerals. Moreover, although references are made below to directions in describing the structure, they are made relative to the drawings (as normally viewed) for convenience. The directions, such as left, right, upper, lower, etc., are not intended to be taken literally or limit the present invention in any form.

FIG. 1 illustrates a full-face helmet. Although the present sun visor is described in relation to a full-face helmet, it should be noted that the present sun visor is not limited to a specific helmet type. The present sun visor can be used with any helmet that has a face shield. The illustrated full-face helmet H includes a full-face shell S, a face shield FS, and a sun visor 10 that is mounted to or integral with the face shield FS. The full-face shell S includes a chin guard CG that wraps around the jaw and has two openings, a bottom opening for receiving the head and a front opening for exposing the eyes and nose. The helmet H also includes appropriate padding (not illustrated) inside the shell for protecting the head. The face shield FS is rotatably or retractably mounted to the shell S and is movable between an open position where the face shield FS is rotated upwardly to expose the front opening and a close position where the face shield FS closes or seals the front opening to provide protection against debris and elements. The face shield FS is generally replaceably mounted. All types of helmets, however, are designed to encase at least a portion of the head. The helmets themselves are well known, and thus the detail description thereof has been omitted.

Figure 2:
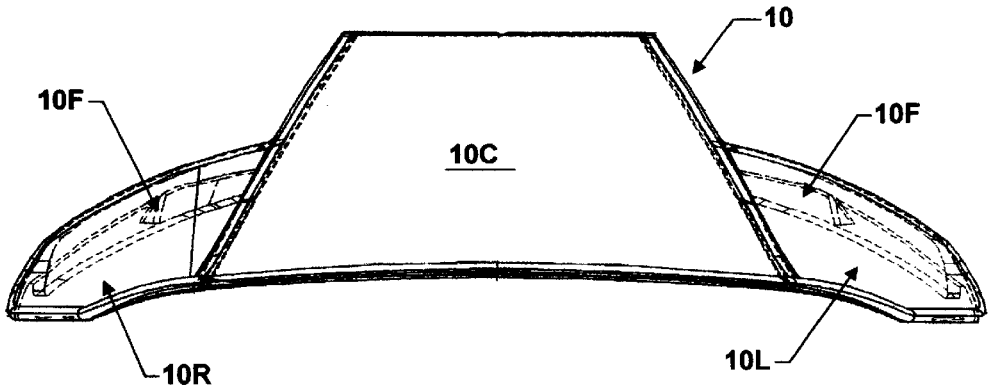
FIG. 2 illustrates a front elevational view of the sun visor of FIG. 1.
Figure 3:
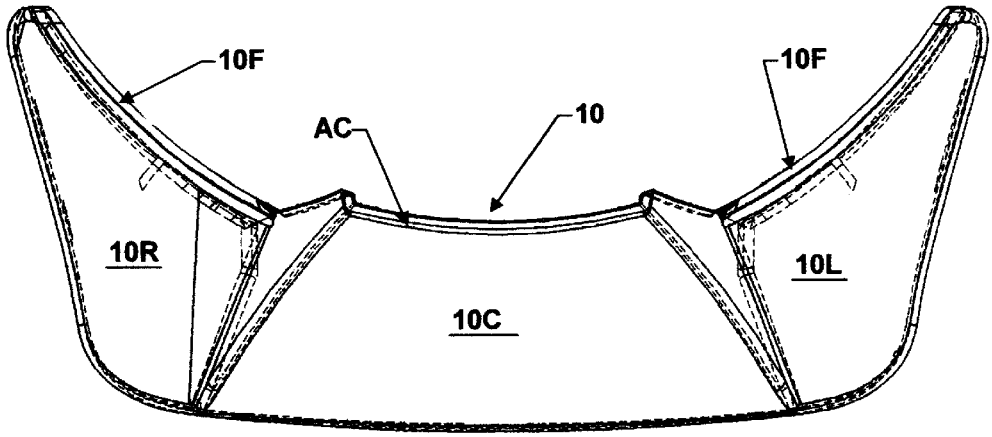
FIG. 3 illustrates a top elevational view of the sun visor of FIG. 1.
Figure 4:
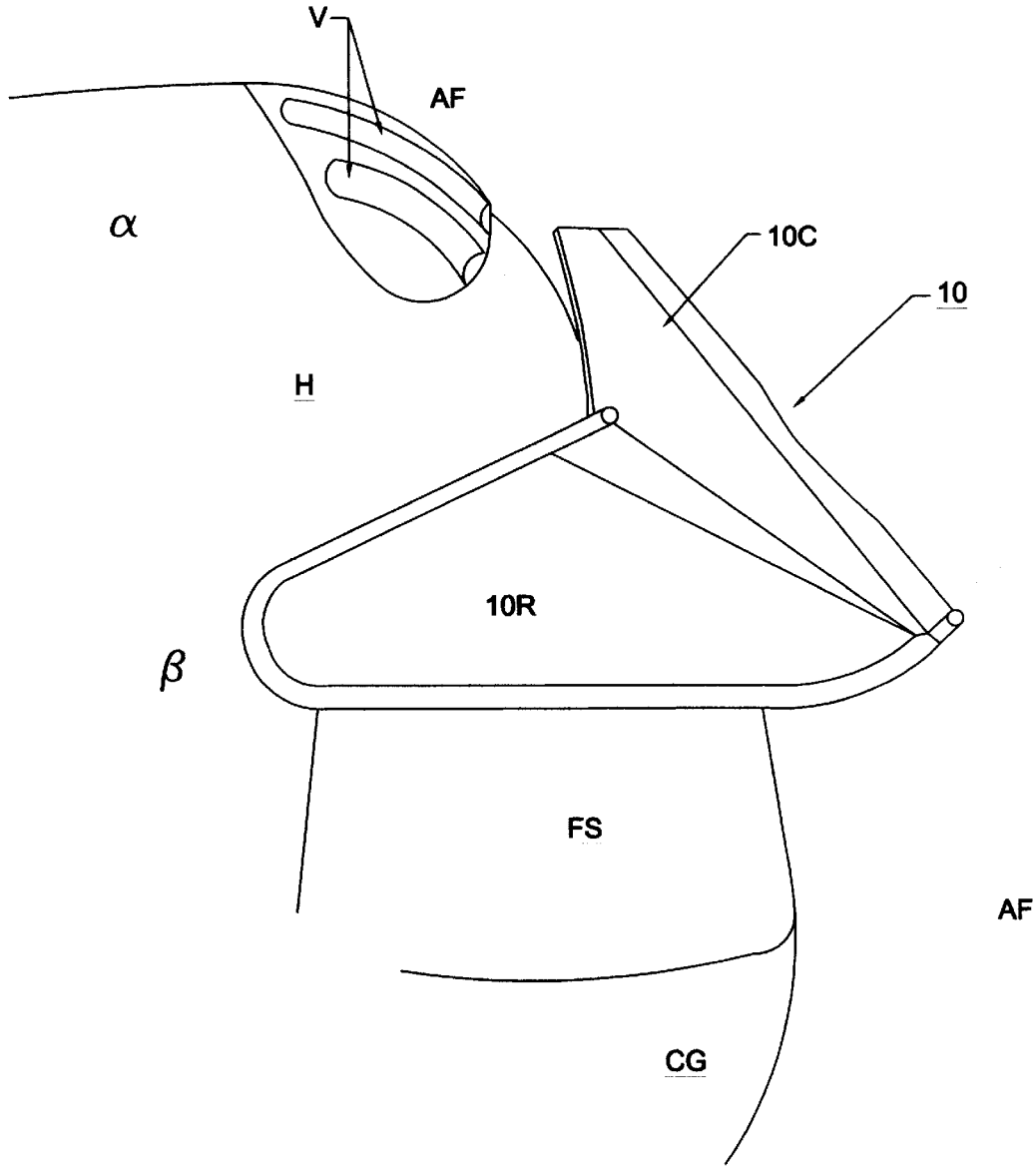
FIG. 4 illustrates a side elevational view of the sun visor of FIG. 1.

The sun visor 10 is mounted to an upper portion of the face shield FS, as illustrated in FIG. 1. Referring to FIGS. 2–4, the sun visor according to the present invention includes a center section 10C, a first or right wing section 10R, and a second or left wing section that form the body of the sun visor 10. The right wing section 10R extends from a first or right side of the center section 10C and the left wing section extends from a second or left side of the center section 10C. The right and left wing sections 10R, 10L generally extend outwardly from the center section 10C in the laterally opposite directions, but curving toward each other as shown in FIGS. 1–5. At least the right and left wing sections 10R, 10L can be curved to substantially follow the same contour or curvature (generally along a vertical axis of the face shield FS). For example, the curve can have around a 5" radius and greater. In this respect, at least the right and left wing sections 10R, 10L can be made of material that is sufficiently rigid, but flexible laterally (substantially about the vertical axis of the face shield FS) so that they can conform to the varying curvatures of the face shield. For instance, the entire sun visor 10 can be integrally or monolithically formed of plastics, such as polyethylene, or other materials having the desired characteristics. The sun visor 10 is preferably made of a substantially opaque material—for example black plastic—to completely block sun light, but also can be made of a colored material, a tinted material or a partially transparent material—for example a "smoke" tinted plastic—that can sufficiently block sun light to prevent dangerous glare.

Figure 5:
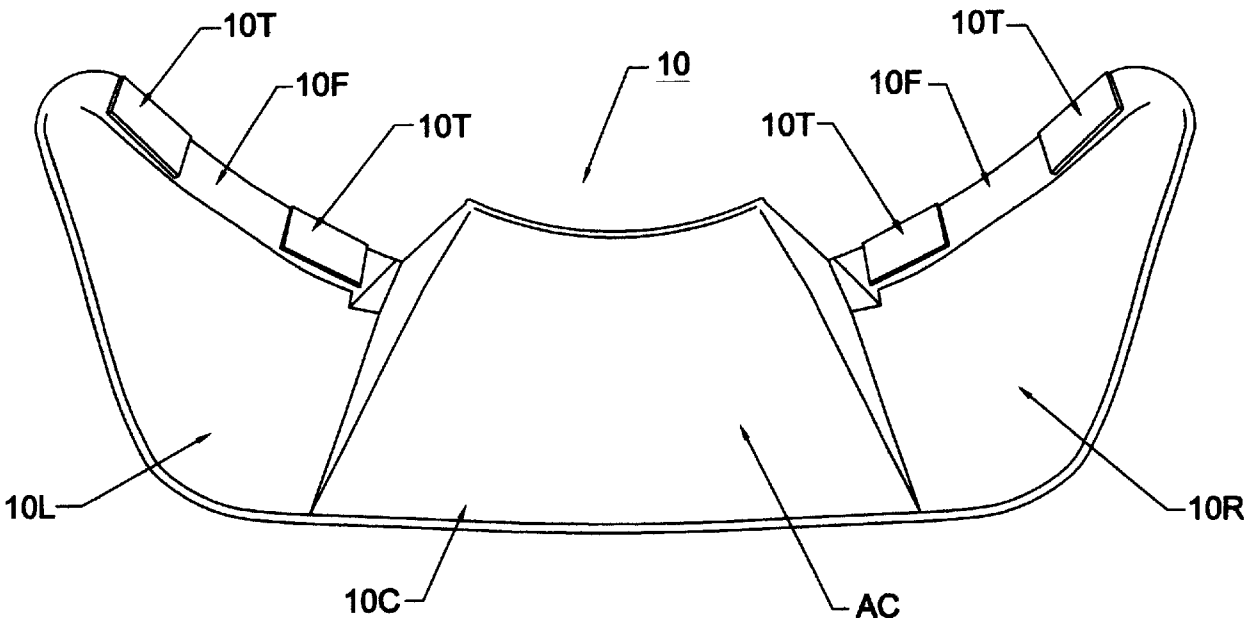
FIG. 5 illustrates a rear view of the sun visor of FIG. 1.

Referring to FIGS. 3–5, some helmets have vents V above the face shield FS, near the front center of the shell. So that the function of the helmet vents is not defeated, the present sun visor 10 enables airflow AF through its center portion 10C, which also reduces the aerodynamic forces exerted on the sun visor 10 and allows for air flow to the vents. In this respect, the right and left wing sections 10R, 10L can be offset or angled in relation to the center section 10C so that the center section is spaced from the face shield FS and the shell S when it is attached to the face shield FS. The spacing between the face shield FS and the shell S forms an air channel AC through which air can flow. More specifically, referring to FIG. 4, the overall slope a of the sun visor 10, i.e., the angle taken along the bottom edge of the right and left wing sections 10R, 10L and the outer surface along the center section 10S, is preferably around 50 degrees to provide an aerodynamic or streamline configuration, although different angles can be applied depending on particular applications and personal preferences. Moreover, the wing angle $\beta$ of the right and left wing sections 10R, 10L, i.e., the angle taken along the bottom edge and top edge of the right and left wings sections 10R, 10L, is preferably 27 degrees, or about one-half of $\alpha$, although other angles can be applied.

Figure 5A:
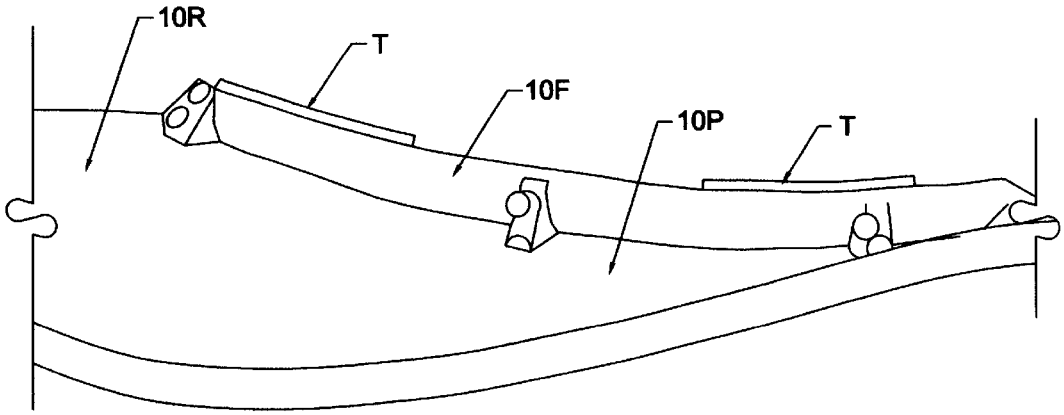
FIG. 5A illustrates an enlarged section of FIG. 5, more clearly illustrating the mounting structure.
Figure 6:
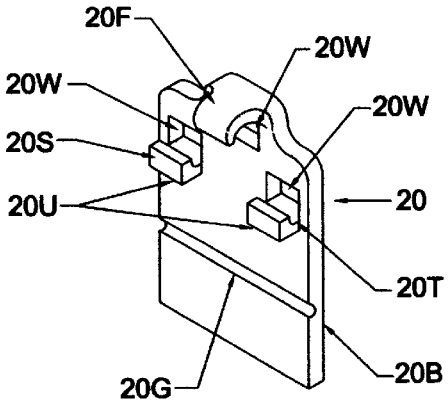
FIG. 6 illustrates a perspective view of a mounting device for detachably mounting the sun visor to a face shield.
Figure 7:
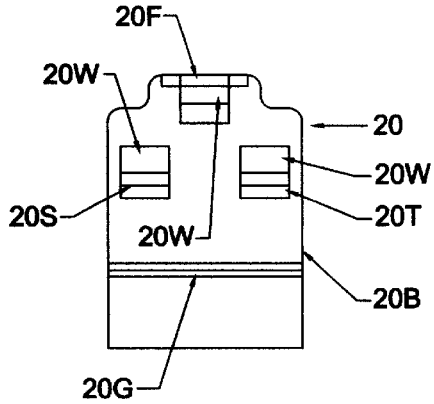
FIG. 7 illustrates a front view of the mounting device of FIG. 6.
Figure 8:
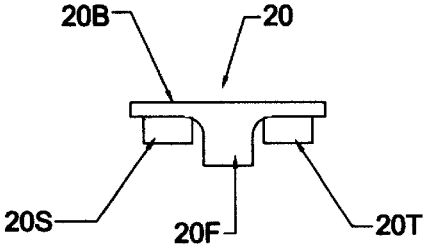
FIG. 8 illustrates a top view of the mounting device of FIG. 6.
Figure 9:
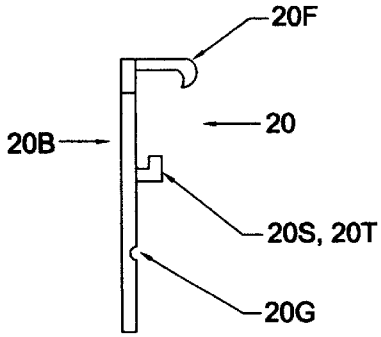
FIG. 9 illustrates a side view of the mounting device of FIG. 6.

Referring to FIGS. 5 and 5A each of the right and left wing sections 10R, 10L can include a mounting structure 10F for fixedly mounting the sun visor 10 to the upper side of the face shield FS. For example, each mounting structure 10F can be a flange or strip of generally curved surface area, having the similar or substantially similar contour of the face shield, extending from the upper portion of the respective wing section 10R, 10L. Moreover, at least the flange 10F and the portions adjacent to the flange can be flexible so that it can follow the contour of the face shield. The right and left flanges 10F (of the right and left wing sections 10R, 10L) can be attached to the upper side of the face shield by any conventional means, such as a double-sided tape 10T. In this regard, one continuous tape or a plurality of shorter tapes 10T can be used for each flange 10F. The tape 10T provides a fixed mount (i.e., non-movable mount), but the sun visor 10 can be removed by forcing it off the face shield, and reattached using new tapes 10T.

Alternatively, referring to FIGS. 5A-9, the sin visor 10 can be detachably mounted in a fixed position to the face shield FS. In this respect, the flange 10F can extend at an angle from the upper side of the respective wing section 10R, 10L. This provides a pocket or channel 10P behind the flange 10F. The mounting structure can use a fastener 20, such as a clip, for each of the right and left flanges 10F to mount the sun visor 10 to the face shield FS. The clip 20 can be mounted directly to the face shield FS. In this regard, the clip 20 can have at least two opposing supports 20P, 20S, 20T that are configured to detachably hold the sun visor. Specifically, each clip 20 includes a substantially thin body 20B and first (or upper middle), second (or lower left), and third (or lower right) anchors 20F, 205, 20T extending from one side of the body 20B. The upper middle anchor 20F is vertically spaced from the lower left and lower right anchors 20S, 20T. The lower left and lower right anchors 20S. 20T are horizontally spaced, with the upper middle anchor 20F positioned therebetween, as more clearly illustrated in FIG. 7. Each of these anchors 20F, 20S, 20T can be a hook or the like extending outwardly from one side of the body 20B. The upper and lower anchors 20F and 20S, 20T can have an opposing hook configuration so that the upper anchor 20F has a downwardly facing opening and the lower anchors 20S, 20T have an upwardly facing opening. The upper anchor 20F is configured to engage the upper end portion of the respective flange 10F and the lower anchors 20S, 20T are configured to engage or straddle at least the lower edge of the respective flange 10F. The upper anchor 20F can engage or straddle the upper end portion of the respective flange 10F and the upper portion of the respective wing section 10R, 10L adjoining the respective flange 10F. The upright hook portions or upwardly extending portion 20U of the lower anchors 20S, 20T can extend upwardly into the pocket 10P. In the illustrated embodiment, a mold release opening 20W is formed adjacent to each of the anchors 20F, 20S, 20T. The clip 20 can be fixedly mounted to the face shield with a double-sided tape, adhesive, or other conventional mechanical fasteners including (but not limited to) screws, clips and pins. The location of the clip 20 can be varied to allow for vertical adjustment of the positioning of the sun visor 10 on the face shield FS. In addition, in the illustrated embodiment, the body 20B includes a horizontally extending CA groove 20G that allows a user to easily break the body 20B along the groove line if a smaller clip 20 is desired. For example, if a user wants to have the sun visor 10 positioned as high as possible on the face shield, the clip 20 may be attached to the face shield FS using the lower portion below the groove 20G such that the groove 20G is aligned with the top edge of the face shield FS. However, if the user wants to move the location of the sun visor 10 downward, for example where the top of the clip 20 is located at the top edge of the face shield FS, the lower portion of the clip 20 can be removed to prevent it from entering into the field of view of the rider.

In the alternative embodiment, at least one clip 20 is mounted to the upper right and left sides of the face shield. Once the clips 20 are mounted to the face shield FS, the sun visor can be snapped into the clips 20. With the anchors 20F, 20S, 20T securing the upper and lower portions of the respective flanges, the sun visor is securely held in place, while allowing it to be manually detachable.

Figure 10:
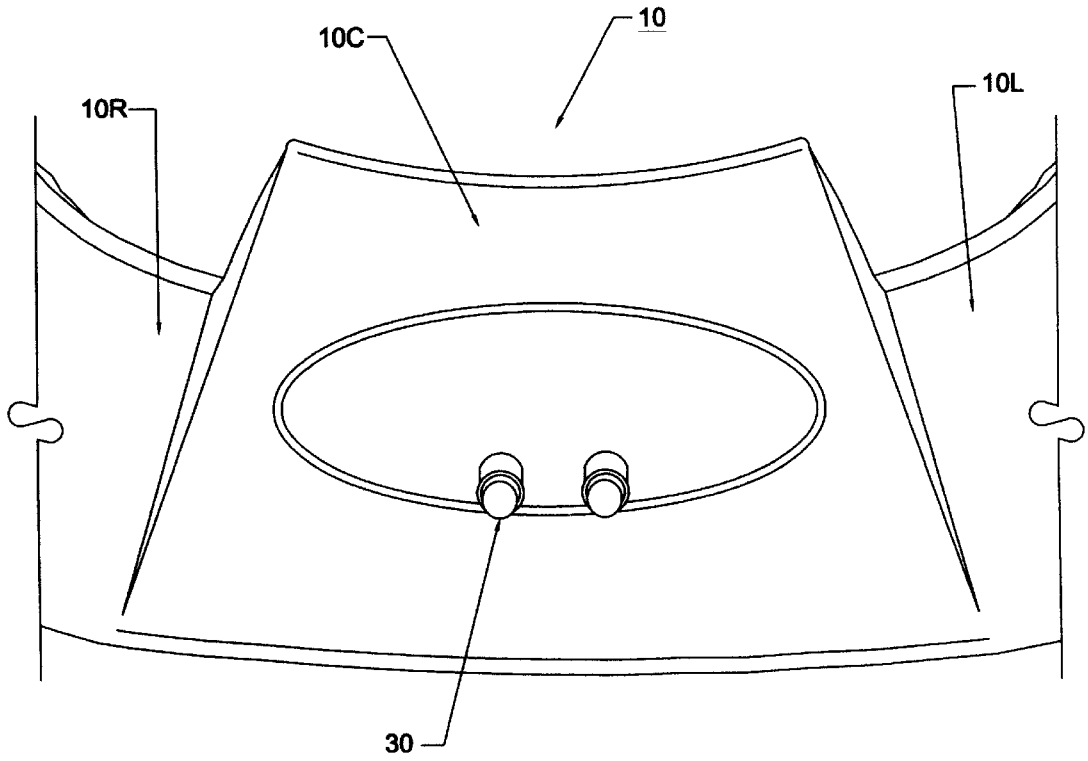
FIG. 10 illustrates another embodiment of the sun visor according to the present invention.
Figure 10A:
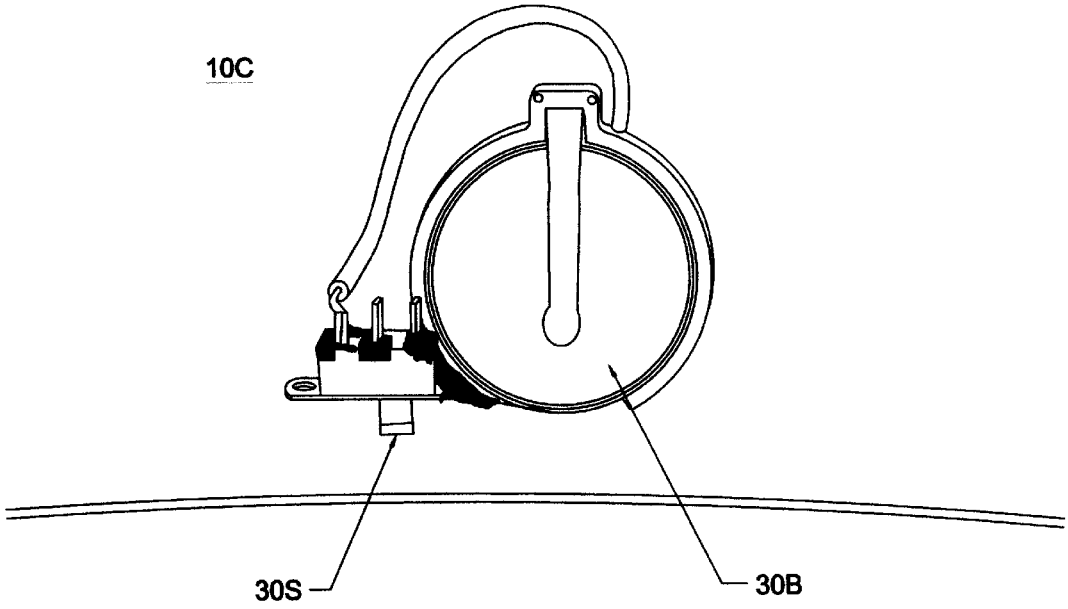
FIG. 10A illustrates a partial view of the rear side of the sun visor of FIG. 10.

For added visibility in dark conditions, the sun visor can include a visibility enhancing device, such as a flashing LED unit, with at least one LED as illustrated in FIGS. 10 and 10A. In the illustrated embodiment, the LED unit includes a battery 30B, two LEDs 30, an ON-OFF switch 30S, and circuitry for driving the LEDs to flash. Such circuitry is well known. A flashing light may not be permitted in some jurisdictions. In such cases, a non-flashing light or LED can be utilized. Alternatively, the visibility enhancing device may include reflective or retro-reflective material.

The present sun visor provides a simple low-cost solution to dangerous riding conditions. The present sun visor can be configured to universally fit all full face helmets or any other helmets that use a face shield. In particular, the present sun visor offers a completely new concept in motor sport safety that allows the user to ride more safely while providing distinct advantages over tinted visors alone. In this respect, it should be noted that the sun visor of the present invention extends outward from the face shield such that a field of shade is provided above the users eyes, such that the user is not required to look through the sun visor.

Given the disclosure of the present invention, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. For example, the presently illustrated embodiments are directed to sun visors 10 that are attached to the face shield FS. However, it is also contemplated that the sun visor 10 can be formed integral with the face shield FS. In this respect, the term "mounted" for the purposes of this application shall include a sun visor attached to the face shield or integrally formed therewith. Still further, in order to maintain the desirable quality of making the sun visor detachable, the mounting clips can be formed integral with the face shield, such that the sun visor can be attached and detached from the integral mounting clips. The scope of the present invention accordingly is to be defined as set forth in the appended claims.

What is claimed is:

1. An apparatus comprising:

a sun visor body; and at least one clip for mounting the sun visor body to a face shield of a safety helmet such that the sun visor body extends outward from the face shield, wherein the clip includes a plate and a plurality of anchors extending from one side of the plate.

2. An apparatus according to claim 1, wherein the plurality of anchors include first, second, and third anchors, the first anchor being vertically spaced from the second and third anchors, and the second and third anchors being horizontally spaced, with the first anchor positioned therebetween.

3. An apparatus according to claim 1, wherein the clip mounts to the face shield with one of a double-sided tape or and adhesive.

4. An apparatus according to claim 1, wherein the clip is formed integrally with the face shield.

5. A sun visor for a safety helmet that uses a face shield, comprising:

a center section;

a first wing section extending from a first side of the center section;

a second wing section extending from a second side of the center section, generally laterally opposite to the first sides;

at least one clip for mounting each of the first and second wing sections to an upper side of the face shield, wherein the first wing section has a first mounting structure for mounting the first wing section to a first upper side of the face shield, wherein the second wing section has a second mounting structure for mounting the second wing section to a second upper side of the face shield, laterally opposite to the first upper side of the face shield, and wherein the clip includes a plate and a plurality of anchors extending from one side of the plate.

6. A sun visor according to claim 5, further including at least one double-sided tape for fixedly mounting each of the first and second wing sections to the respective upper side of the face shield.

7. A sun visor according to claim 5, wherein the clip mounts to the face shield with one of a double-sided tape and an adhesive.

8. A sun visor according to claim 5, wherein the first and second wing sections are curved and substantially complementary to a curvature of the face shield.

9. A sun visor according to claim 8, wherein at least the first and second wing sections are flexible.

10. A sun visor according to claim 5, wherein the first and second wing sections are angled offset in relation to the center section so that the center section is spaced from the face shield to allow air to flow between the face shield and the center section.

11. A sun visor according to claim 5, further including a visibility enhancing device.

12. A sun visor according to claim 11, wherein the visibility enhancing device includes at least one flashing LED.

13. A sun visor for a safety helmet that uses a face shield, comprising:

a center section;

a first wing section extending from a first side of the center section, wherein the first wing section has a first mounting structure for mounting the first wing section to a first upper side of the face shield;

a second wing section extending from a second side of the center section, generally laterally opposite to the first side, wherein the second win section has a second mounting structure for mounting the second wing section to a second upper side of the face shield, laterally opposite to the first upper side of the face shield; and at least one clip for mounting each of the first and second wing sections to the respective upper side of the face shield, wherein the clip has a plurality of supports configured to detachably hold the respective mounting structure, and wherein each clip has a plate and the supports comprise first, second, and third anchors extending from one side of the plate.

14. A sun visor according to claim 13, wherein the fist anchor is vertically spaced from the second and third anchors, and the second and third anchors are horizontally spaced, with the first anchor positioned therebetween.

15. A sun visor according to claim 14, wherein each of the first and second mounting structures comprises a flange extending from the respective wing section for engaging the first, second, and third anchors.

16. A safety helmet comprising:

a shell for encasing at least a portion of a head;

a face shield attached to the shell;

a sun visor; and at least one clip for mounting the sun visor to an upper portion of the face shield such that the sun visor extends outward from the face shield, wherein the clip includes a plate and a plurality of anchors extending from one side of the plate.

17. A safety helmet as claimed in claim 16, wherein the sun visor comprises:

a center section;

a first wing section extending from a first side of the center section; and a second wing section extending from a second side of the center section, generally laterally opposite to the first side, wherein the first wing section has a first mounting structure mounting the first wing section to a first upper side of the face shield, and wherein the second wing section has a second mounting structure mounting the second wing section to a second upper side of the face shield, generally laterally opposite to the first upper side of the face shield.

18. A safety helmet according to claim 17, wherein the first and second wing sections are cured and substantially complementary to a curvature of the face shield.

19. A safety helmet according to claim 17, wherein the first and second wing sections are angled offset in relation to the center section so that the center section is spaced from the face shield to allow air to flow between the face shield and the center section.

20. A safety helmet according to claim 16, wherein the shell is one of a full-face shell and an open-face shell.

21. A safety helmet comprising:

a shell for encasing at least a portion of a head;

a face shield attached to the shell; and a sun visor mounted to an upper portion of the face shield such that the sun visor extends outward from the face shields, wherein the sun visor includes a center section, a first wing section extending from a first side of the center section, and a second wing section extending from a second side of the center section, generally laterally opposite to the first side, wherein the first wing section has a first mounting structure mounting the first wing section to a first upper side of the face shield, wherein the second wing section has a second mounting structure mounting the second wing section to a second upper side of the face shield, generally laterally opposite to the first upper side of the face shield; and at least one clip mounted to each of the first and second upper sides of the face shield, the clip having a plurality of supports that detachably hold the respective mounting structure of the sun visor, wherein each clip includes a plate and the supports comprise the plurality of anchors include first, second, and third anchors extending from one side of the plate, the first anchor being vertically spaced from the second and third anchors, and the second and third anchors being horizontally spaced, with the first anchor positioned therebetween.

22. A safety helmet according to claim 21, wherein each of the first and second mounting structures includes a flange extending from the respective wing section and engaging the first, second, and third anchors.

* * * * *